US011155280B2

(12) United States Patent
Savushkin et al.

(10) Patent No.: US 11,155,280 B2
(45) Date of Patent: Oct. 26, 2021

(54) FREIGHT CAR TRUCK BOLSTER

(71) Applicant: RAIL 1520 IP LTD, Moscow (RU)

(72) Inventors: Roman Aleksandrovich Savushkin, Moscow (RU); Kirill Valterovich Kyakk, St. Petersburg (RU); Pavel Vladimirovich Pavlov, St. Petersburg (RU)

(73) Assignee: RAIL 1520 IP LLC

( * ) Notice: Subject to any disclaimer, the term of this patent is extended or adjusted under 35 U.S.C. 154(b) by 265 days.

(21) Appl. No.: 16/214,812

(22) Filed: Dec. 10, 2018

(65) Prior Publication Data

US 2019/0185029 A1 Jun. 20, 2019

(30) Foreign Application Priority Data

Dec. 14, 2017 (RU) ..... RU2669902

(51) Int. Cl.
*B61F 5/04* (2006.01)
*B61F 1/12* (2006.01)

(52) U.S. Cl.
CPC . *B61F 5/04* (2013.01); *B61F 1/12* (2013.01)

(58) Field of Classification Search
CPC ..... B61F 1/12; B61F 5/00; B61F 5/04; B61F 5/50; B61F 5/52; B61F 5/122; B61F 5/12; B61F 5/34
USPC ..... 105/197.05, 105–185
See application file for complete search history.

(56) References Cited

U.S. PATENT DOCUMENTS

| | | | | |
|---|---|---|---|---|
| 3,482,531 A | | 12/1969 | Tack | |
| 3,924,542 A | | 12/1975 | MacDonnell et al. | |
| 4,135,833 A | | 1/1979 | MacDonnell et al. | |
| 4,196,672 A | | 4/1980 | Bullock | |
| 4,342,266 A | | 8/1982 | Cooley | |
| 4,357,880 A | * | 11/1982 | Weber | B61F 5/122 105/206.1 |
| 4,370,933 A | | 2/1983 | Mulcahy | |
| 5,111,753 A | * | 5/1992 | Zigler | B61F 5/04 105/230 |

(Continued)

FOREIGN PATENT DOCUMENTS

| | | |
|---|---|---|
| RU | 104523 U1 | 5/2011 |
| RU | 118275 U1 | 7/2012 |

(Continued)

*Primary Examiner* — S. Joseph Morano
*Assistant Examiner* — Cheng Lin
(74) *Attorney, Agent, or Firm* — Lerner, David, Littenberg, Krumholz & Mentlik, LLP

(57) ABSTRACT

A novel freight car truck bolster comprising a top member with a center bowl and support shelves for side bearers, a bottom member with bearing surfaces for swing suspension springing elements, going into diagonal tension members, side walls joining the top and bottom members, vertical longitudinal ribs located between the top and bottom members with their thickness increased in the center bowl area, pockets to install friction wedges. The bottom member has increased thickness in the transition areas of the bearing surfaces into the diagonal tension members, and the vertical ribs have thickness increased at the top of the center bowl area, the rounded transitions of the sloping walls into the bottom member bearing surfaces have a radius exceeding the radius of the rounded transitions of the vertical walls into the said bearing surfaces.

11 Claims, 3 Drawing Sheets

3 - 3

(56) References Cited

U.S. PATENT DOCUMENTS

| | | | | |
|---|---|---|---|---|
| 6,196,134 | B1 * | 3/2001 | Stecker | B61F 5/04 105/226 |
| 7,681,506 | B2 * | 3/2010 | Forbes | B61F 5/52 105/226 |
| 10,160,465 | B2 * | 12/2018 | Babanin | B61F 5/04 |
| 2004/0031413 | A1 | 2/2004 | Smith | |

FOREIGN PATENT DOCUMENTS

| | | | |
|---|---|---|---|
| RU | 157798 | U1 | 12/2015 |
| RU | 169160 | U1 | 3/2017 |
| RU | 172017 | U1 | 6/2017 |
| RU | 2669902 | C9 | 1/2019 |
| SU | 885088 | A1 | 11/1981 |
| WO | 2008070953 | A1 | 6/2008 |

* cited by examiner

FREIGHT CAR TRUCK BOLSTER

CROSS REFERENCE TO RELATED APPLICATION

The present application claims priority from Russian Application No. 2 669 902, filed Dec. 14, 2017, the disclosure of which is incorporated herein by reference.

FIELD OF THE INVENTION

The invention relates to railway transport and may be used in truck bolster designs.

BACKGROUND OF THE INVENTION

A freight car truck bolster is disclosed containing a top member with a center bowl and support shelves for side bearers, a bottom member with bearing surfaces for swing suspension springing elements, going into diagonal tension members, two side walls joining the top and bottom members, pockets to install friction wedges on the bolster end parts, each of them being formed by a sloping and two vertical walls (see US 20040031413 A1, publ. Feb. 19, 2004).

A reinforced railway bolster is disclosed containing a top member with a center bowl, a bottom member, two side walls joining the top and the bottom members, two vertical longitudinal ribs of constant thickness connected with the top and bottom members, and two horizontal longitudinal ribs located between the vertical longitudinal ribs above and below across the center bowl width (see U.S. Pat. No. 3,482,531 A, publ. Dec. 9, 1969).

A freight car truck bolster is also disclosed, selected as the closest prior art, containing a top member implemented with a center bowl and support shelves for side bearers, a bottom member implemented with bearing surfaces for swing suspension springing elements, going into diagonal tension members, side walls joining the top and bottom members, two vertical ribs located across the entire bolster width between the top and bottom members, pockets to install friction wedges on the bolster end parts, each of them being formed by one sloping and two vertical walls, made with rounded transitions into the bottom member, while the bottom member being implemented with constant thickness in the transition areas of the bearing surfaces into the diagonal tension members, and the vertical ribs being implemented with their thickness increased in the horizontal direction towards the bolster center, in the area under the center bowl (see RU 118275 U1, publ. Jul. 20, 2012).

A technical problem, which cannot be solved when the prior arrangements are used, is the insufficient bearing capacity of bolsters not providing strength in the stress raiser formation areas. Such areas of the bolster are the transition areas, where the bearing surfaces for swing suspension springing elements go into the diagonal tension members, which (the transition areas) are located under the side bearers, and where breakages in the bolster cross-section are observed. Another area of increased stress is the center bowl area below the bolster top member experiencing increased operating loads. Stress raiser areas are also the sites where the friction wedge pockets are located, in central portions of which the bolsters are particularly weakened and susceptible to the formation of transverse cracks and breakages.

BRIEF SUMMARY OF THE INVENTION

The technical result achieved when using the invention is strengthening of the freight car truck bolster.

The technical result is achieved by the fact that the freight car truck bolster, similarly to the closest prior art, contains a top member implemented with a center bowl and support shelves for side bearers, a bottom member implemented with bearing surfaces for swing suspension springing elements on the end parts, going into diagonal tension members, side walls joining the top and bottom members, vertical longitudinal ribs located between the top and bottom members and implemented with their thickness increased in the center bowl area, pockets to install friction wedges on the bolster end parts, each of them being formed by one sloping and two vertical walls, while the sloping and vertical wall transitions into the bottom member bearing surfaces inside the bolster are made rounded. As distinct from the closest prior art, the bottom member is implemented with its thickness increased in the transition areas of the bearing surfaces into the diagonal tension members, in addition, the vertical ribs are implemented with their thickness increased at the top of the center bowl area, the rounded transitions of the sloping walls into the bottom member bearing surfaces are implemented with a radius exceeding the radius of the rounded transitions of the vertical walls into the said bearing surfaces.

In specific bolster implementations, the bottom member is made with increased thickness of the bearing surfaces, equaling 15-25 mm, and that of the diagonal tension members, equaling 20-30 mm, to the thickness in the transition areas of the bearing surfaces into the diagonal tension members, equaling 30-40 mm.

In specific bolster implementations, the vertical longitudinal ribs are made with their thickness increased in the horizontal direction from 10-20 mm on the bolster end parts to 20-30 mm in the center bowl area and with their thickness increased in the vertical direction from 20-30 mm at the bottom of the center bowl area to 30-40 mm at the top of the center bowl area.

In specific bolster implementations, the rounded transitions into the bottom member of the sloping walls and of the pocket vertical walls are made with radiuses R1 and R2 equaling 30-50 mm and 10-20 mm, respectively.

BRIEF DESCRIPTION OF THE DRAWINGS

The invention is shown on the drawings as follows.

DETAILED DESCRIPTION

Figure 1:
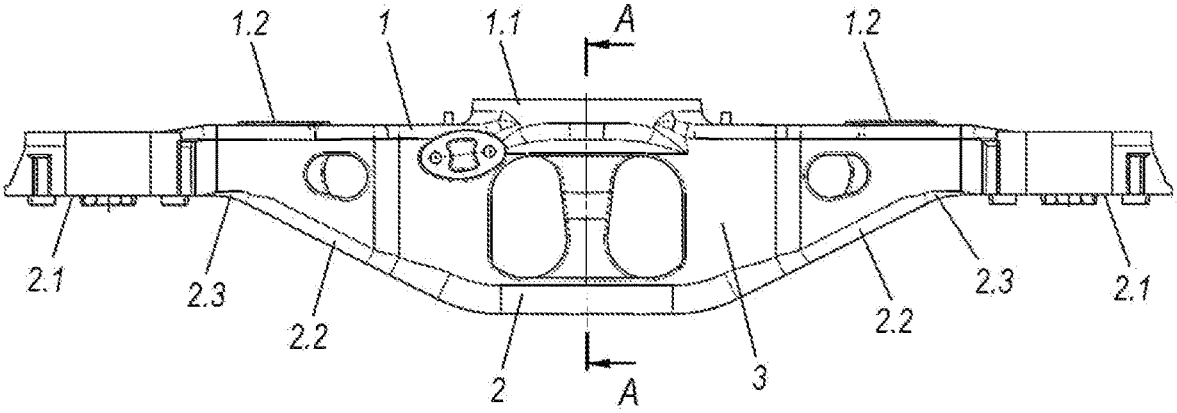
FIG. 1—Freight car truck bolster, front view.
Figure 2:
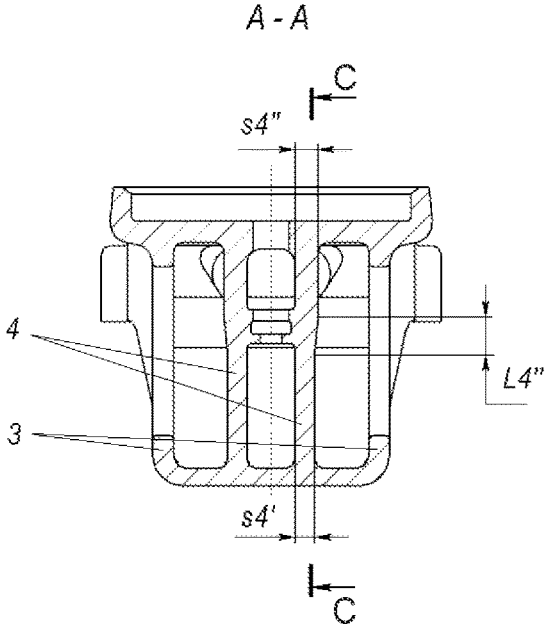
FIG. 2—Section A-A on FIG. 1.

The freight car truck bolster (FIGS. 1, 2, 3, 4) is made of 20 GFL steel* and contains top member 1, bottom member 2, side walls 3, joining top 1 and bottom 2 members, vertical longitudinal ribs 4 located between top 1 and bottom 2 members, pockets 5 to install friction wedges on the bolster end parts. In side walls 3 and vertical longitudinal ribs 4, manufacturing through holes are made (not shown as drawing positions).

Top member 1 of the bolster is implemented with cylindrical center bowl 1.1 in the central part and with support shelves 1.2 for side bearers in the bolster end parts. Cylindrical center bowl 1.1 is implemented with circular stop collar 1.1.1 and flat bearing surface 1.1.2.

Figure 3:
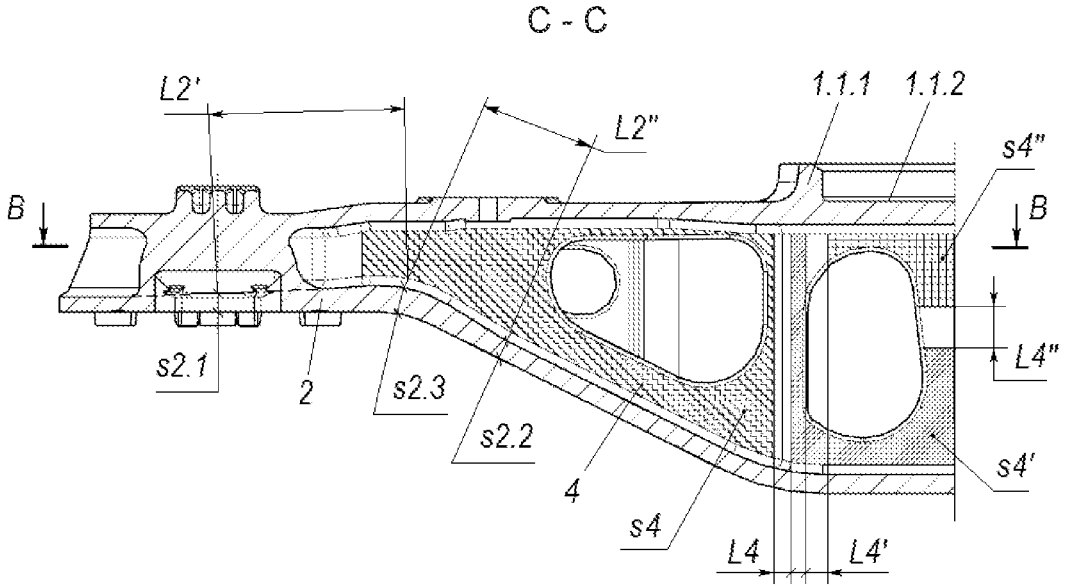
FIG. 3—Section C-C on FIG. 2.

Bottom member 2 of the bolster is implemented with bearing surfaces 2.1 for swing suspension springing elements, going into diagonal tension members 2.2 via areas 2.3. Thickness s.2.1 of bearing surfaces 2.1 is 15-25 mm, thickness s2.2 of diagonal tension members 2.2 is 20-30 mm, thickness s2.3 of areas 2.3 is 30-40 mm (FIG. 3). Increase of thickness value s2.1 to thickness value s2.3 is implemented within the section with length L2' equaling 230-300 mm, and thickness value s2.2 to thickness value s2.3, within the section with length L2' equaling 120-180 mm. Length L2' and length L2" values are measured relative to the respective area 2.3. The implementation of thickness values s2 of bottom member 2 and length values L2 of the sections variable by thickness below the lower boundary values in the above ranges does not provide the bolster bearing capacity; the implementation of said parameters with values above the upper boundary values in the above ranges is impractical from the perspective of the structure specific metal consumption increase. The implementation of variable thickness bottom member with the proposed increase in thickness of the transition areas of the bearing surfaces for swing suspension springing elements into the diagonal tension members allows to increase the bearing capacity providing the static and endurance strength of these stress raiser areas when using the bolster as a part of the freight car truck.

Between top 1 and bottom 2 members two vertical longitudinal ribs 4 are implemented, parallel to each other over the bolster length between areas 2.3 and going into one rib above bearing surfaces 2.1. Ribs 4 have variable thickness increased in the horizontal direction in the area of center bowl 1.1, consistent with the increase of thickness from s4 to s4' and to s4". Ribs 4 have variable thickness increased also in the vertical direction from the bot tom to top of the center bowl 1.1 area with the increase of thickness from s4' and to s4". Vertical longitudinal ribs 4 (FIGS. 2, 3, 4) are implemented on the bolster end parts with thickness s4 equaling 10-20 mm, on the bottom of the center bowl 1.1 area with thickness s4' equaling 20-30 mm and on the top of center bowl 1.1 area under top member 1 with thickness s4" equaling 30-40 mm. In the horizontal direction, the increase of thickness s4 to thickness s4' is implemented symmetrically on the bolster both sides within the section with length L4 equaling 10-30 mm; and length L4 is measured in the direction towards the bolster center relative to the plane perpendicular to the bolster longitudinal axis and located at a distance of no more than 5 mm beyond the outside wall of center bowl 1.1 circular stop collar 1.1.1 from the point of intersection of the said outside wall with the longitudinal axis. The said plane positioning at a distance of more than 5 mm shifts the beginning of thickness increase of vertical longitudinal ribs 4 further beyond center bowl 1.1, where the thickness increase does not exert a significant impact on the strengthening in the center bowl area. The increase of thickness s4' to thickness s4" in the horizontal direction is implemented within the sections with length L4' equaling 50-70 mm; and length L4' is measured in the direction from the bolster center relative to the plane perpendicular to the bolster longitudinal axis and located at a distance of no more than 5 mm beyond the inside wall of center bowl 1.1 circular stop collar 1.1.1 from the point of intersection of the said inside wall with the longitudinal axis. The said plane positioning at a distance of more than 5 mm shifts the beginning of thickness increase of vertical longitudinal ribs 4 closer to center bowl 1.1 flat bearing surface 1.1.2 and, as a result, may compromise the strength in the center bowl area. The implementation of thickness values s of vertical longitudinal ribs 4 and length values L below the lower boundary values in the above ranges decreases the bolster bearing capacity; the implementation of said parameters with values above the upper boundary values in the above ranges increases the structure specific metal consumption. In the vertical direction, the increase of thickness s4' to thickness s4" is implemented in the center bowl 1.1 area within the section with length L4" equaling 50-70 mm, and length L4" is measured from the middle height of vertical longitudinal ribs 4 in the direction of top member 1. The implementation of variable thickness longitudinal ribs with steady increase in thickness in the direction of the top member allows excluding stress raiser formation in the center bowl area when using the bolster as a part of the freight car truck, which results in the bolster strengthening.

Figure 4:
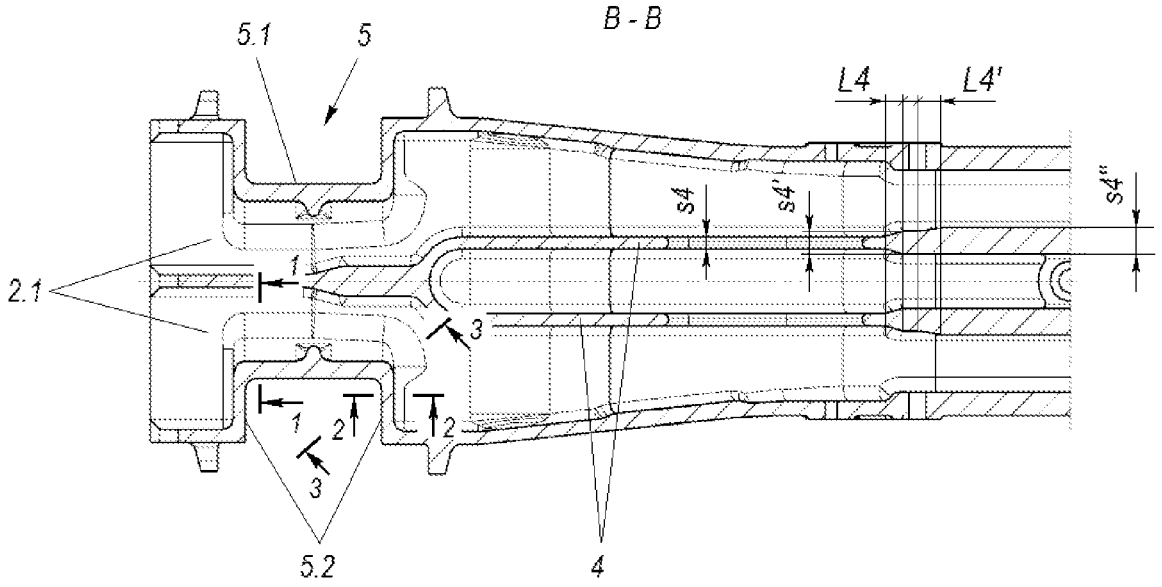
FIG. 4—Section B-B on FIG. 3.
Figure 5:
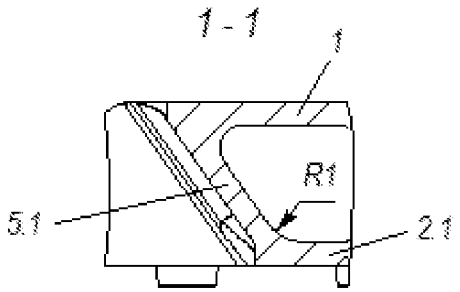
FIG. 5—Section 1-1 on FIG. 4.
Figure 6:
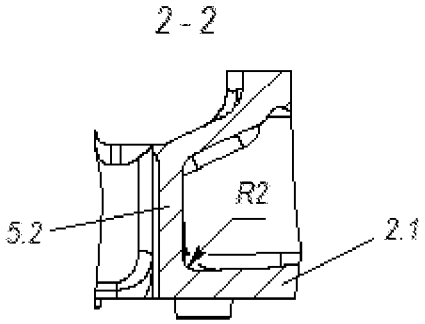
FIG. 6—Section 2-2 on FIG. 4.
Figure 7:
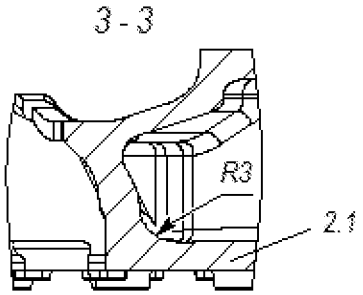
FIG. 7—Section 3-3 on FIG. 4.

In each end part of the bolster, two pockets 5 to install friction wedges are implemented (FIG. 4). Each pocket 5 is formed by one sloping wall 5.1 and two vertical walls 5.2. Inside the bolster, sloping 5.1 and vertical 5.2 walls are joined with bottom member 2 at the points of bearing surfaces 2.1 with rounded transitions made with radiuses R1 and R2, respectively. In the areas of two angles between sloping 5.1 and vertical 5.2 walls, the rounded transitions are implemented with radius R3. Radius R1 is 30-50 mm (FIG. 5); radius R2 is 10-20 mm (FIG. 6); the value of radius R3 changes smoothly within the range of 10-20 mm at the point of interface with radius R1 to 30-50 mm at the point of interface with radius R2 (FIG. 7). In case of implementation of radii R1, R2 and R3 with values below the lower boundary values of the above ranges, stress raiser formation is possible at the said points of rounded transitions; implementation of radii R1, R2 and R3 with values above the upper boundary values of the above ranges decreases the sloping and vertical wall surfaces intended to make contact with friction wedges, which reduces the bolster serviceability and decreases the bolster bearing capacity. The implementation of radius R1 exceeding radius R2 allows to significantly reduce the likelihood of breakages in the areas of pockets for friction wedges and formation of transverse fractures in the pocket walls and, as a result, to strengthen the bolster.

The proposed values of bottom member 2 thickness s2 increase, vertical longitudinal ribs 4 thickness s4 increase and of the vertical wall rounded transitions into pockets 5 bearing surfaces radii R are calculated using the correct-by-construction design method.

The freight car truck bolster operates as follows.

The forces from freight car body act on the bolster through center bowl 1.1 and support shelves 1.2 for side bearers. From the bolster, the load on the truck side frames is transmitted through bearing surfaces 2.1 for swing suspension springing elements. The said sections of the bolster, as areas of stress raiser formation, are reinforced using the proposed design solutions allowing increasing the freight car truck bolster bearing capacity and its strength.

The invention claimed is:

1. A freight car truck bolster comprising:

a top member and a bottom member both members extending horizontally from a first end to a second end;

at least one sidewall connecting the top member and the bottom member;

wherein the bottom member comprises:

a first end section at the first end;

a second end section at the second end;

a central section between the first and second end sections;

a first tension section between the first end section and the central section;

a second tension section between the second end section and the central section;

wherein the first and second tension sections are sloping;

wherein the bottom member has a variable thickness, and the thickness of the bottom member is larger where end sections transition into the tension sections than the thickness at the end sections and the thickness at the tension sections;

at least one pocket proximate to the first end and at least one pocket proximate to the second end, wherein each of the pockets comprises:

two vertical walls and one sloping wall between the two vertical walls;

wherein transition areas between the walls of the pockets and the bottom member are curved;

wherein the curved transition areas between the walls of the pockets and the bottom member have a radius in the range of 30 mm to 50 mm proximate to the sloping walls, a radius in the range of 10 mm to 20 mm proximate to the vertical walls, and a changing radius in the range of 10 to 20 mm proximate to where the sloping wall and vertical walls meet.

2. The freight car truck bolster of claim 1, wherein the thickness of the bottom member at the end sections is in the range of 15 mm to 25 mm, the thickness of the bottom member at the tension sections is in the range of 20 mm to 30 mm, and the thickness of the bottom member where the end sections transition into the tension sections is in the range of 30 mm to 40 mm.

3. The freight car truck bolster of claim 1, wherein the tension sections are diagonal.

4. The freight car truck bolster of claim 1, further comprising at least one rib extending vertically and horizontally between the top and bottom members, wherein the top member comprises a bowl disposed between the first and second ends; and wherein the at least one rib has a variable thickness and that thickness is greater proximate to the bowl in the top member than proximate to the bottom member.

5. The freight car truck bolster of claim 4 wherein the at least one sidewall and the at least one rib comprise apertures therethrough.

6. The freight car truck bolster of claim 4, wherein the thickness of the least one rib is greater proximate to the central section of the bottom member than proximate to the end sections of the bottom member.

7. The freight car truck bolster of claim 6, wherein the thickness of the at least one rib gradually increases from an area proximate to the end sections of the bottom member to an area proximate to the central section of the bottom member and wherein the thickness of the at least one rib gradually increases from the area proximate to the central section of the bottom member to the area proximate to the bowl of the top member.

8. The freight car truck bolster of claim 6 wherein the at least one rib comprises two ribs that are apart proximate to the central and tension sections of the bottom member and transition into a single integral rib at the end sections of the bottom member.

9. A freight car truck bolster comprising:

a top member and a bottom member both members extending horizontally from a first end to a second end;

at least one sidewall connecting the top member and the bottom member;

at least one rib extending vertically and horizontally between the top and bottom members, wherein the top member comprises a bowl disposed between the first and second ends;

wherein the bottom member comprises:

a first end section at the first end;

a second end section at the second end;

a central section between the first and second end sections;

a first tension section between the first end section and the central section;

a second tension section between the second end section and the central section;

wherein the first and second tension sections are sloping;

wherein the at least one rib has a thickness that changes;

wherein the thickness of the rib is greater proximate to the bowl in the top member than proximate to the bottom member;

wherein the thickness of at least one rib is greater proximate to the central section of the bottom member than proximate to the end sections of the bottom member;

wherein the changes in the thickness of the at least one rib are gradual;

at least one pocket proximate to the first end and at least one pocket proximate to the second end, wherein each of the pockets comprises:

two vertical walls and one sloping wall between the two vertical walls;

wherein transition areas between the walls of the pockets and the bottom member are curved and have a radius in the range of 30 mm to 50 mm proximate to the sloping walls, a radius in the range of 10 mm to 20 mm proximate to the vertical walls, and a changing radius in the range of 10 to 20 mm proximate to where the sloping wall and vertical walls meet.

10. The freight car truck bolster of claim 9, wherein the thickness of the bottom member at the end sections is in the range of 15 mm to 25 mm, the thickness of the bottom member at the tension sections is in the range of 20 mm to 30 mm, and the thickness of the bottom member where the end sections transition into the tension sections is in the range of 30 mm to 40 mm.

11. The freight car truck bolster of claim 9, wherein the bottom member has a thickness that changes and the thickness of the bottom member is larger where end sections transition into the tension sections than at the end sections and at the tension sections wherein the thickness of the bottom member at the end sections is in the range of 15 mm to 25 mm, the thickness of the bottom member at the tension sections is in the range of 20 mm to 30 mm, and the thickness of the bottom member where the end sections transition into the tension sections is in the range of 30 mm to 40 mm.

* * * * *